US006755918B2

(12) United States Patent
Ger et al.

(10) Patent No.: US 6,755,918 B2
(45) Date of Patent: Jun. 29, 2004

(54) METHOD FOR TREATING MAGNESIUM ALLOY BY CHEMICAL CONVERSION

(76) Inventors: Ming-Der Ger, No. 65-1, Tzu-An 6 Tsun, Rui Yuan Li, Ta-Xi Cheng, Taoyuan Hsien (TW); Kuang-Hsuan Yang, No. 180, Min-Sheng Rd., San Lin Tsun, Lung Tan Siang, Taoyuan Hsien (TW); Yuh Sung, 7 Fl., No. 72, Lane 165, Yuan-Hwa Rd., Chung-Li City, Taoyuan Hsien (TW); Wen-Hwa Hwu, 7 Fl., No. 72, Lane 165, Yuan-Hwa Rd., Chung-Li City, Taoyuan Hsien (TW); Yu-Chuan Liu, 7 Fl., No. 72, Lane 165, Yuan-Hwa Rd., Chung-Li City, Taoyuan Hsien (TW)

( * ) Notice: Subject to any disclaimer, the term of this patent is extended or adjusted under 35 U.S.C. 154(b) by 124 days.

(21) Appl. No.: 10/167,479

(22) Filed: Jun. 13, 2002

(65) Prior Publication Data

US 2003/0230365 A1 Dec. 18, 2003

(51) Int. Cl.[7] ..... C23C 22/00
(52) U.S. Cl. ..... 148/243; 148/273; 148/275
(58) Field of Search ..... 148/243, 273, 148/275

(56) References Cited

U.S. PATENT DOCUMENTS

| | | | | | |
|---|---|---|---|---|---|
| 6,316,115 | B1 | * | 11/2001 | Lai et al. | 428/469 |
| 2002/0084002 | A1 | * | 7/2002 | Hardin et al. | 148/243 |
| 2003/0026912 | A1 | * | 2/2003 | Ostrovsky | 427/402 |
| 2003/0150526 | A1 | * | 8/2003 | Bengston et al. | 148/254 |
| 2003/0213771 | A1 | * | 11/2003 | Ohshita et al. | 216/83 |

FOREIGN PATENT DOCUMENTS

| | | | | |
|---|---|---|---|---|
| WO | WO 01/06036 | A1 | * 1/2001 | C23C/22/56 |

* cited by examiner

*Primary Examiner*—Andrew L. Oltmans
(74) *Attorney, Agent, or Firm*—Bacon & Thomas

(57) ABSTRACT

The present invention discloses a method for treating magnesium alloys by chemical conversion. This method can improve corrosion resistance and paint adhesion of magnesium alloys, and produces an admirable appearance. Additionally, the method of the present invention is more environmentally friendly than conventional processes, because non-chromate chemicals are used in acid pickling and chemical conversion. Furthermore, the method of the present invention can be widely applied to the magnesium alloys manufactured by casting and rolling.

8 Claims, No Drawings

METHOD FOR TREATING MAGNESIUM ALLOY BY CHEMICAL CONVERSION

BACKGROUND OF THE INVENTION

1. Field of the Invention

The present invention relates to a method for treating magnesium alloys and particularly, to a method for treating magnesium alloys by non-chromate chemical conversion.

2. Description of Prior Art

As one of the most popular materials, magnesium alloys are environmentally friendly, lighter (only ⅔ of aluminum's specific weight), better in heat transfer (51 w/m·k of thermal conductivity), stronger, and exhibit excellent ability in shielding electromagnetic interrupt (EMI). Additionally, raw magnesium is abundant, composing 2.5% of the earth's crust and 0.13% of the earth's bodies of water. Therefore, magnesium alloys have replaced some plastic materials and have been widely applied to the 3C industries (computer, communication and consumption electronics productions) and appliances. However, magnesium alloys corrode easily when exposed to atmosphere. Therefore, additional surface treatment is required. Currently, the chemical conversion process improves corrosion resistance and paint adhesion of the magnesium alloys. In general, the surface film after the chemical conversion process is quite thin, having thickness less than 5 $\mu$m, so that this treatment causes no appreciable dimensional changes to the parts.

One conventional surface treatment of magnesium alloys is disclosed in U.S. Pat. No. 4,676,842, in which chromate is used in acid pickling and chemical conversion. Four chemical conversion processes developed by R. W. Murray and J. E. Hills include mechanical polishing, solvent cleaning, alkali cleaning and acid pickling, as described in "Magnesium Finishing: Chemical Treatment and Coating Practices". These processes can be applied individually or in combination, depending on whether the magnesium alloy was manufactured by casting or rolling. Similarly, chromate is used in acid pickling in the above processes. Scales formed during heating can be treated with a mixture of nitric acid and acetic acid. U.S. Pat. No. 2,302,939 also mentioned a method for removing oxides, in which organic acids such as tartaric acid, citric acid and acetic acid, are used and show better results than inorganic acids. The magnesium alloys are then treated with nitric acid-chromate to form corrosion-resistant surface films thereon.

The casting process produces more complex impurities than the rolling process, such as oxides or hydroxides of magnesium alloys, aluminum alloys, etc. and smuts and/or scales generated by grease or carbonates, and are removed with difficulty. Strong acids and alkalis are thus needed.

Using chromate in conventional processes prevents corrosion and conserves a proper appearance. Unfortunately, chromate will be forbidden because of its toxicity to human beings and the environment. Therefore, it's necessary to develop an alternative surface treatment for magnesium alloys to minimize pollution.

SUMMARY OF THE INVENTION

The object of the present invention is to provide a method for treating magnesium alloys, which generates less pollutants by a non-chromate chemical conversion process and is suitable for the magnesium alloys manufactured by casting or rolling.

Another object of the invention is to provide a method for treating magnesium alloys, which can improve corrosion resistance and paint adhesion of magnesium alloys.

A further object of the invention is to provide a method for treating magnesium alloys, which can produce an admirable appearance.

In order to achieve the above objects, the method of the present invention primarily includes steps (1) providing a magnesium alloy having at least one surface for treatment; (2) cleaning the surface of the magnesium alloy with an alkali cleaner; (3) rinsing the magnesium alloy with water to eliminate the alkali cleaner; (4) pickling the magnesium alloy with acid cleaner to eliminate oxides and metal impurities on the surface; (5) treating the surface of the magnesium alloy with a chemical conversion processing agent to form a surface film having corrosion resistance and color protection properties; and (6) treating the surface with a sealing agent to reinforce corrosion resistance and paint adhesion of the surface film.

In the present invention, non-chromate chemicals used in acid pickling and chemical conversion processes can decrease pollution that frequently occurs in the conventional processes. Additionally, Ti or Si coupling agents of the present invention facilitate in improving corrosion resistance and paint adhesion of the magnesium alloys.

The acid cleaner primarily includes nitric acid and fluoride. The chemical conversion-processing agent primarily includes a VB metal compound and a pH-adjusting agent. The coupling agent also further includes a solvent, a solvent aid and water.

DETAILED DESCRIPTION OF THE INVENTION

The present invention discloses a method for treating magnesium alloys by chemical conversion, which can improve corrosion resistance and paint adhesion of the magnesium alloys, and produce an admirable appearance without additional paint on surfaces thereof. A wide variety of colors from dark green to gold can also be formed.

In general, surface treatment of metals, such as iron, aluminum, zinc, cadmium and magnesium, includes cleaning with alkali or acid cleaner. Whereby following processes such as painting can be applied easily and the products have better properties and appearances. This process is known as metal chemical conversion. The chemicals used in the present invention are suitable for all magnesium alloys, particularly for AZ31, AZ61 and AZ91. The surface treatment of the present invention primarily includes steps of:

(1) cleaning the surface of the magnesium alloy with an alkali cleaner to degrease contamination;

(2) rinsing the magnesium alloy with water to eliminate the alkali cleaner;

(3) pickling the magnesium alloy with acid cleaner to eliminate oxides and metal impurities on the surface;

(4) rinsing the magnesium alloy with water to eliminate the acid cleaner;

(5) treating the surface of the magnesium alloy with a non-chromate agent to form a slightly coarse surface film for corrosion resistance as well as enhancing adhesive of paint; and (6) treating the surface with organometallic Ti or Silane to reinforce corrosion resistance and paint adhesion of the surface film.

Each of the above steps can be applied individually or associatively to various painting technologies.

Alkali cleaning is usually the first step of surface treatment, in which an alkali cleaner is applied to remove oil contamination on the surface of magnesium alloys. The alkali cleaner can be prepared by users or selected from commercial productions such as Turco-4215-NC-LT. The temperature can be set between 40° C. and 60° C., preferably between 45° C. and 55° C. The time for treatment is about 5 to 10 minutes, with the pH value preferably kept between 9 and 11.

The alkali cleaner generally includes an alkali as the main component and a surfactant, wherein the alkali component is usually $Na_2CO_3$, NaOH or $Na_3PO_4$, and the surfactant can be the additives mentioned in U.S. Pat. No. 4,370,173. Additionally, chelating agent such as sodium gluconate can be used to remove magnesium or calcium ions, and therefore reduces water hardness, enabling easy oil elimination by the surfactant. The alkali cleaner is suitable for removing impurities that are not strongly attacked to the surface of the magnesium alloy. As for the oxides or impurities with stronger adhesion, the acid pickling has to be carried out after water rinse. By means of alkali cleaning, water rinsing, acid pickling, and water rinsing again, a clean surface of magnesium alloy can be obtained for chemical conversion. The rinsing water is preferably deionized water in order to prevent the surface film from being deteriorated by undesired agents such as chlorine ions.

The acid pickling agent in the present invention is prepared with $NH_4HF_2$ (10–25 g/L) and nitric acid (30–50 c.c./L) at room temperature (RT), in which the magnesium alloy is steeped for 30–60 seconds. Furthermore, adding a fluoro-surfactant to the acid pickling agent could promote activating effects and prevent magnesium alloy from etching greatly by the acid pickling agent. For water rinsing after acid pickling, flowing deionized water is preferred, and the magnesium alloy is preferably dipped therein for at least 5 minutes to completely remove the acid pickling agent.

After alkali cleaning and acid pickling, the surface of the magnesium alloy is active, and should be brought to the chemical conversion process as soon as possible to avoid surface oxidization. In the present invention, the chemical conversion processing agent primarily includes VB or rare-earth metal salts, for example, $V_2O_5$, $Na_2V_2O_4$, $NaVO_3$ and $CeCl_3$, etc. The chemical conversion-processing agent usually has a concentration between 10 g/L and 80 g/L, preferably between 40 g/L and 60 g/L, and has a pH between 3 and 10, preferably between 6 and 8. The time for the chemical conversion process is about 1–10 minutes, preferably 3–5 minutes, and the temperature is controlled between room temperature and 60° C., preferably between 35° C. and 45° C. A wetting agent, for example, TX-100 (Merck), CO-720 (Aldrich) or dodecyl sodium sulfate (Aldrich) is used to enhancing reaction rates and roughing the surface of the alloy, which is instrumental in adhesion of paint thereon. Addition of the pH-adjusting agent varies the film surface color, for example, low pH for greenish color, medium pH for golden color, and high pH for dark green color. The pH-adjusting agents are such chemicals as acetic acid, formic acid, NaOH, ammonia and ethylene diamine, etc.

In order to have superior corrosion resistance and painting adhesion on the surface film, sealing treatment is involved after the chemical conversion. The sealing agent can be a silane or titanium coupling agent, for example, vinyl silane, glycidoxy silane and mercapto silane, and the commercial productions include Dow Corning Z-6040, Z-6032, Z-6020, etc., or KEN-REACT KRTTS, KR44, KR38S, etc. for the titanium coupling agents. The above agents are prepared with 18 MΩ pure water, alcohols, etc.

The method for preparing the coupling agent may include:

1. mixing the coupling agent (x)ml with an equivalent amount of alcohol;
2. adding pure water (y)ml=(x/m.w. of the coupling agent)××18 into the above mixture;
3. resting the above solution for 20 minutes and then diluting to 10% with a solvent aid.

After surface treatment, samples are preferably left for 24 hours before painting to achieve better corrosion resistance and adhesion.

EXAMPLES

The following examples are illustrated to show the advantages of the present invention, but not limited to the scope thereof.

Salt Spray Test

Several pieces of the magnesium alloys (AZ61) measuring 100×50×1 mm are treated with alkali cleaning, acid pickling, chemical conversion processes and sealing, and are then compared with untreated and chromate treated samples by salt spray test. The salt spray test is carried out in accordance with ASTM B117. Samples are then timed for rust spot occurrence. A rust spot having an area over 2 $mm^2$ or 3 rust spots less than 2 $mm^2$ are used to judge quality thereof according to specification of MIL-C-81706/5541.

Paint Adhesion Test

The paint adhesion test is carried out according to U.S. Military specification MIL-C-81706/5541 and MIL-P-23377F, in which samples of Mg—Al alloys (AZ61) measuring 100×50×1 mm are treated with the chemical conversion process, painted with MIL-P-23377F paint, and aged for seven days. The samples are then nicked with a tungsten carbon knife to form two parallel lines that thoroughly penetrate the paint film and are one inch from each other. The treated samples are then left in deionized water for 24 hours, and dried with hot air. 3M® No.250 tape segments are then pasted on the parallel lines of the dried samples and dried by blowing with hot air. The dried tapes settle for 15 minutes and are removed quickly. The paint films are then observed for peeling or deformation.

The following test results are listed in Table 1 and Table 2.

Comparative Example 1

Six AZ61-rolling samples measuring 100×50×1 mm are treated with alkali cleaning. Three samples undergo the salt spray test, and the other three undergo paint adhesion tests. The alkali cleaning includes steps with the compounds and conditions as follows:

| Step | Compound | Concentration | Temperature | Time |
|---|---|---|---|---|
| Alkali Cleaning | Turco-4215-NC-LT | 30 g/L | 40° C. | 10 min |
| | $H_2O$ | make up to 1 L | | |
| Water Rinsing | — | — | RT | 30 sec |

Comparative Example 2

The samples are the same as comparative example 1, which undergo the steps with the compounds and conditions as follows:

| Step | Compound | Concentration | Temperature | Time |
|---|---|---|---|---|
| Alkali Cleaning | Turco-4215-NC-LT | 30 g/L | 40° C. | 10 min |
| | $H_2O$ | make up to 1 L | | |
| Water Rinsing | — | — | RT | 30 sec |
| Acid Pickling | $NH_4HF_2$ | 20 g/L | RT | 15 sec |
| | $HNO_3$ | 40 c.c./L | — | — |
| | $H_2O$ | make up to 1 L | — | — |
| Water Rinsing | — | — | RT | 30 sec |
| Chromate conversion | $CrO_3$ | 28 g/L | — | — |
| Coating(DOW19) | $CaSO_4$ | 28 g/L | — | — |
| | H2O | make up to 1 L | — | — |
| Water Rinsing | — | | RT | 30 sec |

Example 1

A sample is treated as in Comparative Example 1, with the compounds and conditions as follows:

| Step | Compound | Concentration | Temperature | Time |
|---|---|---|---|---|
| Alkali Cleaning | Turco-4215-NC-LT | 30 g/L | 40° C. | 10 min |
| | $H_2O$ | make up to 1 L | | |
| Water Rinsing | — | — | RT | 30 sec |
| Acid Pickling | $NH_4HF_2$ | 20 g/L | RT | 15 sec |
| | $HNO_3$ | 40 c.c./L | — | — |
| | $H_2O$ | make up to 1 L | — | — |
| Water Rinsing | — | — | RT | 30 sec |
| Chemical Conversion | $CeCl_3$ | 20 g/L | 40° C. | 5 min |
| | CO720 | 1 g/L | — | — |
| | $H_2O$ | make up to 1 L | — | — |
| Water Rinsing | — | — | RT | 30 sec |

Example 2

A sample is treated as in Comparative Example 1, with the compounds and conditions as follows:

| Step | Compound | Concentration | Temperature | Time |
|---|---|---|---|---|
| Alkali Cleaning | Turco-4215-NC-LT | 30 g/L | 40° C. | 10 min |
| Water Rinsing | — | — | RT | 30 sec |
| Acid Pickling | $NH_4HF_2$ | 20 g/L | RT | 15 sec |
| | $HNO_3$ | 40 c.c./L | — | — |
| | $H_2O$ | make up to 1 L | — | — |
| Water Rinsing | — | — | RT | 30 sec |
| Chemical Conversion | $V_2O_5$ | 10 g/L | 40° C. | 5 min |
| | CO720 | 1 g/L | — | — |
| | $H_2O$ | make up to 1 L | — | — |
| Water Rinse | — | — | RT | 30 sec |

Example 3

A sample is treated as in Comparative Example 1, with the compounds and conditions as follows:

| Step | Compound | Concentration | Temperature | Time |
|---|---|---|---|---|
| Alkali Cleaning | Turco-4215-NC-LT | 30 g/L | 40° C. | 10 min |

-continued

| Step | Compound | Concentration | Temperature | Time |
|---|---|---|---|---|
| Water Rinsing | — | — | RT | 30 sec |
| Acid Pickling | $NH_4HF_2$ | 20 g/L | RT | 15 sec |
| | $HNO_3$ | 40 c.c./L | — | — |
| | $H_2O$ | make up to 1 L | — | — |
| Water Rinsing | — | — | RT | 30 sec |
| Chemical Conversion | $CeCl_3$ | 20 g/L | 40° C. | 5 min |
| | CO720 | 1 g/L | — | — |
| | $H_2O$ | make up to 1 L | — | — |
| Water Rinsing | — | — | RT | 30 sec |
| Sealing | | | 60° C. | 10 sec |
| | Z-6030 | 10 g/L | — | — |
| | $CH_3OH$ | 10 c.c./L | — | — |
| | $H_2O$ | make up to 1 L | — | — |

Example 4

A sample is treated as in Comparative Example 1, with the compounds and conditions as follows:

| Step | Compound | Concentration | Temperature | Time |
|---|---|---|---|---|
| Alkali Cleaning | Turco-4215-NC-LT | 30 g/L | 40° C. | 10 min |
| Water Rinsing | — | — | RT | 30 sec |
| Acid Pickling | $NH_4HF_2$ | 20 g/L | RT | 15 sec |
| | $HNO_3$ | 40 c.c./L | — | — |
| | $H_2O$ | make up to 1 L | — | — |
| Water Rinsing | — | — | RT | 30 sec |
| Chemical Conversion | $V_2O_5$ | 10 g/L | 40° C. | 5 min |
| | CO720 | 1 g/L | — | — |
| | $H_2O$ | make up to 1 L | — | — |
| Water Rinsing | — | — | RT | 30 sec |
| Sealing | | | 60° C. | 10 sec |
| | Z-6030 | 10 g/L | — | — |
| | $CH_3OH$ | 10 c.c./L | — | — |
| | $H_2O$ | make up to 1 L | — | — |

TABLE 1

| Comparative Example | Salt Spray Test (hr) Chemical Conversion | Painting | Paint Adhesion | Color of the Surface Film |
|---|---|---|---|---|
| 1 | <1 | 200 | No Good | — |
| 2 | <10 | >300 | Good | Brassy |

TABLE 2

| Example | Salt Spray Test (hr) Chemical Conversion | Painting | Paint Adhesion | Color of the Surface Film |
|---|---|---|---|---|
| 1 | 10~15 | >300 | Good | Cream-Colored |
| 2 | >20 | >300 | Good | Cream-Colored |
| 3 | >20 | >300 | Good | Greenish |
| 4 | >20 | >300 | Good | Greenish |

Although the present invention has been explained in relation to its preferred embodiment, it is to be understood that many other possible modifications and variations can be made without departing from the spirit and scope of the invention as hereinafter claimed.

What is claimed is:

1. A method for treating magnesium alloy by chemical conversion, comprising:

(1) providing a magnesium alloy having at least one surface for treatment;

(2) alkaline cleaning of said surface of said magnesium alloy with an alkali cleaner;

(3) rinsing said magnesium alloy with water to eliminate said alkali cleaner;

(4) acid pickling said magnesium alloy with acid pickling agent to remove oxides and metal impurities on said surface;

(5) treating said surface of said magnesium alloy with a chemical conversion coating agent to form a surface film having properties of corrosion resistance, enhancing paint adhesion as well as colorful appearance; and (6) treating said surface with a sealing agent to reinforce corrosion resistance and paint adhesion to said surface film;

wherein said chemical conversion processing agent comprises a metal salt, a reaction enhancing agent, pH adjusting agent and a solvent, wherein said metal salt is selected from the group consisting of $V_2O_5$, ammonium orthovanadate, ammonium metavanadate and $CeCl_3$, and has a concentration ranging from 10 to 80 g/L, and said reaction enhancing agent is fluorinated alkyl quaternary ammonium iodides, and has a concentration ranging from 100 to 800 ppm (V/V), and said pH adjusting agent is selected from the group consisting of acetic acid, formic acid, sodium hydroxide, ammonia and ethylene diamine, and said solvent is water, methanol or ethanol.

2. The method of claim 1, wherein said step (2) is performed at a temperature ranging from 40 to 60° C. for 3 to 20 minutes, and said alkali cleaner has a pH value ranging from 9 to 12.

3. The method of claim 2, wherein said alkali cleaner comprises an alkali chemical, a surfactant and water, wherein said alkali chemical is selected from the group consisting of carbonates, phosphates and hydroxides or mixtures thereof, and said surfactant is selected from the group consisting of alkyl sulfate or sulfonate.

4. The method of claim 1, wherein said step (4) is performed at a temperature ranging from 20 to 50° C. for 5 to 50 seconds, and said acid cleaner has a pH value ranging from 3 to 6.

5. The method of claim 4, wherein said acid cleaner comprises an acid chemical and water, wherein said acid chemical is selected from the group consisting of nitric acid, hydrochloric acid, $NH_4HF_2$ and potassium fluoride or mixtures thereof.

6. The method of claim 1, wherein said step (5) is performed a a temperature ranging from 20 to 60° C. for 1 to 10 minutes, and said chemical conversion processing agent has a pH value ranging from 3 to 10.

7. The method of claim 1, wherein said step (6) is performed at a temperature ranging from 20 to 100° C. for 1 to 10 minutes, and said sealing agent has a pH value ranging from 3 to 10.

8. The method of claim 7, wherein said sealing agent comprises a coupling agent and a solvent, wherein said coupling agent is selected from the group consisting of vinyl silane, glycidoxy silane, mercapto silane and a titanium coupling agent, and has a concentration ranging from 5 to 20 g/L, and said solvent is selected from the group consisting of methanol, ethanol, propanol and butanol.

* * * * *